US006764019B1

(12) United States Patent
Kayahara et al.

(10) Patent No.: US 6,764,019 B1
(45) Date of Patent: Jul. 20, 2004

(54) METHOD FOR SERVICING AND MAINTAINING HEAT SUPPLY EQUIPMENT

(75) Inventors: Toshihiro Kayahara, Matsuyama (JP); Kazuhiro Tachino, Matsuyama (JP); Yasuo Watanabe, Hojo (JP)

(73) Assignee: Miura Co., Ltd., Ehime-ken (JP)

( * ) Notice: Subject to any disclaimer, the term of this patent is extended or adjusted under 35 U.S.C. 154(b) by 793 days.

(21) Appl. No.: 09/708,553

(22) Filed: Nov. 9, 2000

(30) Foreign Application Priority Data

Jun. 30, 2000 (JP) ..... 2000-198933

(51) Int. Cl.[7] ..... G05D 23/00

(52) U.S. Cl. ..... 236/51; 236/94; 702/184; 702/185

(58) Field of Search ..... 236/51, 94; 165/11.1, 165/11.2; 62/125, 126, 127, 129, 130; 702/182, 183, 184, 185

(56) References Cited

U.S. PATENT DOCUMENTS 5,279,458 A * 1/1994 DeWolf et al. ..... 236/51
5,446,677 A * 8/1995 Jensen et al. ..... 62/126
5,586,446 A * 12/1996 Torimitsu ..... 62/127
5,682,329 A * 10/1997 Seem et al. ..... 62/126
5,729,474 A * 3/1998 Hildebrand et al. ..... 702/184

* cited by examiner

*Primary Examiner*—Harry B. Tanner
(74) *Attorney, Agent, or Firm*—Birch, Stewart, Kolasch & Birch, LLP

(57) ABSTRACT

In a method for servicing and maintaining heat supply equipment, which includes making a servicing and maintenance contract to implement equipment performance maintenance, function maintenance, abnormality recovery and a diagnosis for preventive maintenance of the heat supply equipment, providing a communication network of the heat supply equipment, a first computer of a control station and a second computer of a control center communicatable thereamong via communication means, and implementing contents of the servicing and maintenance contract based on information obtained by communications in this network, the method includes receiving abnormality occurrence data, requesting and receiving detailed information, taking measures based on analysis results of these data and information, transferring the abnormality occurrence data, and obtaining and analyzing information for diagnosis. Thus, in heat supply equipment provided with boilers or the like, preventive maintenance can be achieved securely and efficiently, and a prompt countermeasure can be taken even with occurrence of an abnormality so that the resultant halt time can be made as short as possible. Further, a 24-hour support can be fulfilled with the least staff efficiently.

4 Claims, 6 Drawing Sheets

METHOD FOR SERVICING AND MAINTAINING HEAT SUPPLY EQUIPMENT

The present application claims priority from Japanese Application No. 198933/2000 filed Jun. 30, 2000.

BACKGROUND OF THE INVENTION

The present invention relates to a method for servicing and maintaining heat supply equipment provided with a boiler or the like. More particularly, the invention relates to a method for servicing and maintaining heat supply equipment, which can fulfill 24-hour response and which includes preventive maintenance for securing safety and security.

For servicing and maintenance of boilers in heat supply equipment, maintenance stations are provided at individual controlled areas, and a serviceman disposed at each of these maintenance stations performs the servicing and maintenance of the boiler. When any one of the boilers has halted due to occurrence of an abnormality, a telephone contact will be made from a person in charge of management of the boiler to the maintenance station, and a serviceman will take measures based on the contents of this contact.

However, it has been often the case that only telephone contact could not make the cause of the abnormality clear, or going to the site and finding the cause would take long time, or that even if the cause is determined, the serviceman does not have replacement parts and so needs setting out again. Further, when the serviceman is on the way to the site or checking for the cause of the abnormality, the boiler is left halted. Further, if the person in charge of management is late in finding the halt of the boiler, the halt period would be elongated resultantly. Like this, if the halt period of the boiler is elongated, production factories or the like would incur a lot of loss. Therefore, the boilers need to be prevented from occurrence of abnormalities to the best possible, and besides, if an abnormality has occurred, it is necessary to take a prompt countermeasure.

Abnormalities of the boiler can occur during the night or on holidays of the maintenance station. Therefore, it is desirable that maintenance stations be ready for prompt countermeasures over 24 hours. For this purpose, there arises a need of increasing the number of servicemen at the maintenance station.

SUMMARY OF THE INVENTION

Accordingly, an object of the present invention is to fulfill a so-called preventive maintenance, i.e. a maintenance for preventing occurrences of abnormalities in advance, securely and efficiently in heat supply equipment provided with boilers or the like, and to fulfill a prompt countermeasure even with occurrence of an abnormality so that the resultant halt time can be made as short as possible. A further object of the invention is to fulfill 24-hour support with the least staff efficiently.

In order to achieve the above object, in a first aspect of the present invention, there is provided a method for servicing and maintaining heat supply equipment, which includes making a servicing and maintenance contract to implement equipment performance maintenance, function maintenance, abnormality recovery and a diagnosis for preventive maintenance of the heat supply equipment, providing a communication network of the heat supply equipment, a first computer of a control station and a second computer of a control center communicatable thereamong via communication means, and implementing contents of the servicing and maintenance contract based on information obtained by communications in this network, the method comprising the steps of: upon occurrence of an abnormality, performing a sequence of processes that: when the first computer receives abnormality occurrence data automatically transmitted from the heat supply equipment, the control station confirms contents of the abnormality occurrence data and requests detailed information as to the abnormality occurrence data from the heat supply equipment, receives the information, the control station analyzes the abnormality occurrence data and the detailed information and, based on results of this analysis, issues an instruction for dispatch of a serviceman or for recovery by a person in charge of management of the heat supply equipment; in a case where the control station makes no response such as in nighttime or on holidays, transferring the abnormality occurrence data from the first computer to the second computer, and by the control center instead of the control station, performing the sequence of processes, to thereby fulfill the contents of the servicing and maintenance contract over 24 hours a day; and for execution of the diagnosis, obtaining information relating to the diagnosis of the heat supply equipment via the communication means and performing an analysis of the obtained information.

In a second aspect of the invention, the method for servicing and maintaining heat supply equipment further includes, in a periodic inspection for fulfilling the contents of the servicing and maintenance contract, obtaining information as to inspection items in advance via the communication means and analyzing the obtained information, so that possible places of object equipment units that need an emphatic inspection or possible places that need parts replacement can be narrowed down before the serviceman goes for the periodic inspection.

In a third aspect of the invention, the method for servicing and maintaining heat supply equipment further comprises periodically requesting and receiving operating data and heat control data from the heat supply equipment so as to confirm whether or not the communication means is in a normal state and, as required, transferring and storing the two types of data from the heat supply equipment into the first computer of the control station.

In a fourth aspect of the invention, the method for servicing and maintaining heat supply equipment further comprises: totaling the operating data and the heat control data and offering an analysis result or a heat balance report based on this totalization to the servicing and maintenance contractor.

Next, embodiments of the present invention are described. The servicing and maintaining method of the invention is used for heat supply equipment provided with boilers or the like, where the boilers include various kinds of boilers such as steam boiler, hot water boiler, heat medium boiler and the like. The heat supply equipment includes equipment for supplying cold and heat, such as cooling and heating machines. Further, the servicing and maintaining method of the invention is applicable also to equipment such as water treatment systems or the like additionally provided to the boilers.

First of all, for the implementation of servicing and maintenance of heat supply equipment, a servicing and maintenance contract is made with the owner of the heat supply equipment or user (hereinafter, referred to as "servicing and maintenance contractor"). This servicing and maintenance contract provides for implementation of equipment performance maintenance, function maintenance, abnormality recovery and a diagnosis for preventive maintenance of the heat supply equipment. That is, the contract provides for maintaining the equipment in a successful state (high efficiency state), maintaining the proper functions of the equipment by preventing the equipment from halting due to occurrence of any abnormality, and recovering the equipment, even upon occurrence of some abnormality, to the normal state immediately. Further, as a diagnosis for preventive maintenance, the contract provides for performing a periodic inspection, for example, on a four-month basis.

The heat supply equipment and a first computer of the control station as well as a second computer of the control center are communicatably connected to each other via communication means. That is, the heat supply equipment is provided with a computer to be connected to the first computer and the second computer, where this computer is given by computers of individual units of equipment or a computer that integrates together those individual units. Then, the contents of the servicing and maintenance contract are implemented according to information from the mutual communications. In this connection, as the control stations, maintenance stations at which a serviceman is disposed play the role of the maintenance stations, while the control stations are provided at individual controlled areas. Also, the control center is intended to integrally support the individual control stations, and provided at a single place or a plurality of places. That is, in the daytime on weekdays, each of the control stations is ready for response according to information sent from the heat supply equipment. In the nighttime on weekdays and all days on holidays, the control center is ready for response, where 24-hour response with the least staff is enabled. For communications, general telephone lines and exclusive lines are used, where these lines may be either wire type or wireless type.

Next, processes for implementing the contents of the servicing and maintenance contract based on the information from the heat supply equipment is described in detail.

First, as a first process, when an abnormality has occurred to the heat supply equipment, abnormality occurrence data is transmitted automatically from the heat supply equipment to the first computer, and this abnormality occurrence data is received by the first computer. The abnormality occurrence data is classified into abnormality data and prediction data. The abnormality data is intended to make it known that the heat supply equipment is halted due to actual occurrence of an abnormality. For example, occurrence of a non-ignition or occurrence of a low water level corresponds to this abnormality data. The prediction data, on the other hand, does not involve immediately halting the heat supply equipment, but makes it known that there is a high potentiality of halt of the heat supply equipment due to occurrence of an abnormality in a few days. For example, a power degradation of the feed water pump corresponds to this prediction data. If the power of the feed pump has degraded, a low water level becomes more likely to occur.

Accordingly, by automatically receiving the abnormality occurrence data, even when the person in charge of management of the heat supply equipment is late in finding a halt of the heat supply equipment, it becomes possible for the control station side to know without delay the halt of the heat supply equipment and make an immediate response. Also, by receiving not only the abnormality data but also the prediction data, it becomes possible to take a countermeasure before the heat supply equipment is halted due to occurrence of an abnormality in the heat supply equipment.

As a second process, the control station, on receiving the abnormality occurrence data, confirms the contents of the received abnormality occurrence data and further requests and receives detailed information associated with the abnormality occurrence data from the heat supply equipment. That is, the control station transmits a request signal for detailed information to the heat supply equipment by operating the first computer. Then, in response to this request signal, the detailed information is returned from the heat supply equipment.

As a third process, the control station analyzes the abnormality occurrence data and the detailed information and, based on a result of this analysis, issues instructions for the dispatch of a serviceman or the recovery to the person in charge of management of the heat supply equipment. By so doing, the control station can be informed as to what operating state the heat supply equipment is currently, without going to the place where the heat supply equipment is installed. Thus, the control station is enabled to immediately instruct the serviceman or the person in charge of management about a proper countermeasure.

Accordingly, it becomes possible in more cases to achieve the recovery by telephone instructions to the person in charge of management of the heat supply equipment, so that the time and labor for dispatch of the serviceman can be reduced and besides that the halt time of the heat supply equipment can be shortened to a large extent. Further, in cases where the serviceman has to be dispatched to the site, since parts or the like necessary for repair can be prepared by specifically determining the cause of an abnormality in advance, the serviceman is allowed to immediately begin repairing at the site and, besides, do not need to be dispatched again.

For this third process, when the decision can be made based on only the analysis result of the abnormality occurrence data, it is possible to omit the reception of detailed information.

Further, as a fourth process, when the control station makes no response in the nighttime or on holidays or the like, the abnormality occurrence data is transferred from the first computer to the second computer, and the control center performs the second process and the third process instead of the control station. That is, when the recovery can be achieved by a telephone instruction, the control center instructs the person in charge of management of the heat supply equipment of the recovery. When the dispatch of a serviceman is necessary, an emergency contact with the serviceman in charge at each control station is made from the control center, and the serviceman in charge fulfills the response. Accordingly, the contents of the servicing and maintenance contract are implementable over 24 hours with the least staff efficiently.

With regard to the control center, in the case where the serviceman at the maintenance station will be absent in the daytime on weekdays, a control station of a neighboring area may be assigned to serve as the control center and fulfill a support function. The case where "the control station makes no response" includes a case where no response can be made due to the absence of a serviceman or other reasons, and a case where it is previously set so as to make no responses as in the nighttime on weekdays or all day on holidays. Further, with respect to the method of transfer, it may also be arranged that the setting as to whether to transfer can be switched by operating the first computer, or that if no operation is done in the first computer within a specified time period after receiving the abnormality occurrence data, then the transfer is automatically effected. Furthermore, the form of transfer includes one in which the abnormality occurrence data is transmitted from the heat supply equipment to the second computer without using the first computer.

Further, as a fifth process, for the diagnosis, information as to the diagnosis of the heat supply equipment, such as the abnormality occurrence data as well as later-described operating data or heat control data, is obtained via the communication means, and then the obtained information is analyzed. That is, for the execution of the diagnosis for preventive maintenance, necessary information is obtainable at any time necessary.

In periodic maintenances (to be executed, for example, every four months) to implement the contents of the servicing and maintenance contract, the fifth process is performed, by which information as to the inspection items is obtained in advance via the communication means, and then the obtained information is analyzed. By so doing, it is enabled to narrow the possible places that need an emphatic inspection or the possible places that need parts replacement with respect to equipment units targeted for the periodic inspection. As a result, the man-hours necessary for the periodic inspection can be reduced to a large extent.

Further, by requesting and receiving operating data and heat control data from the heat supply equipment periodically (for example, every month), it is checked whether or not the communication means is in the normal state. By so doing, the abnormality of the communication means can be detected earlier, so that mutual communications by the communication means can be performed securely. Then, as required, the two types of data are transferred and stored from the computer of the heat supply equipment into the first computer of the control station. Accordingly, data storage means attached to the computer of the heat supply equipment may be given by one which is relatively smaller in capacity and lower in price. It is noted here that data as to the number of ignitions or burning time or the like are received as the operating data, while data as to the operating efficiency or water tube temperature or the like are received as the heat control data.

The received operating data and heat control data are then totaled, and analysis results or heat balance reports based on this totalization are offered to the servicing and maintenance contractor. That is, the totalization of the two types of data is executed periodically (e.g., every month), and analysis results or heat balance reports of the periodic totalization are sent to the servicing and maintenance contractor as a periodical report (monthly report). For example, operating efficiency, amount of evaporation, use amount of fuel and the like are reported. The sending of the periodical report is implemented by mail, facsimile, electronic mail and the like. Like this, by periodically offering the analysis results or the heat balance report to the servicing and maintenance contractor, the servicing and maintenance contractor is allowed to easily know the status of operation of the heat supply equipment and therefore use the heat supply equipment with the sense of ease.

As shown above, with this constitution, preventive maintenance for the heat supply equipment can be achieved securely and efficiently, so that measures are taken before abnormalities occur to the heat supply equipment so that the heat supply equipment can be operated without being halted. Moreover, even if an abnormality has occurred, a prompt countermeasure can be taken so that the halt time can be shortened as much as possible. Further, the man-hours needed to perform service and maintenance can be shortened to a large extent and besides the service and maintenance of high efficiency can be achieved. Furthermore, 24-hour response can be fulfilled with the least staff.

DETAILED DESCRIPTION OF THE PREFERRED EMBODIMENTS

Figure 1:
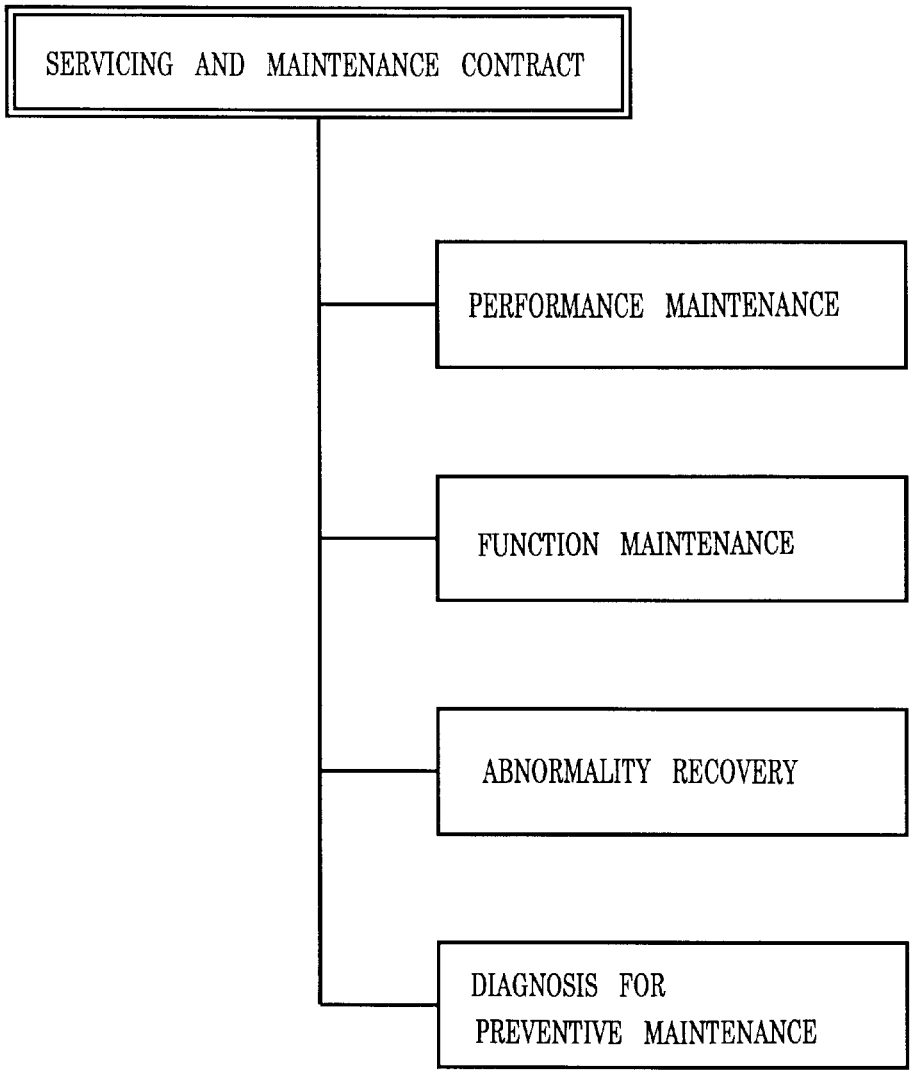
FIG. 1 is an explanatory view schematically showing the servicing and maintenance contract in the present invention.

Hereinbelow, a concrete example of the present invention is described in detail with reference to the accompanying drawings. For execution of the method for servicing and maintaining heat supply equipment according to the present invention, first, an onerous servicing and maintenance contract is made with the owner or user (hereinafter, referred to as "servicing and maintenance contractor") of the heat supply equipment. Contents of this servicing and maintenance contract are to implement performance maintenance, function maintenance, abnormality recovery and a diagnosis for preventive maintenance of units of the heat supply equipment as shown in FIG. 1.

Figure 2:
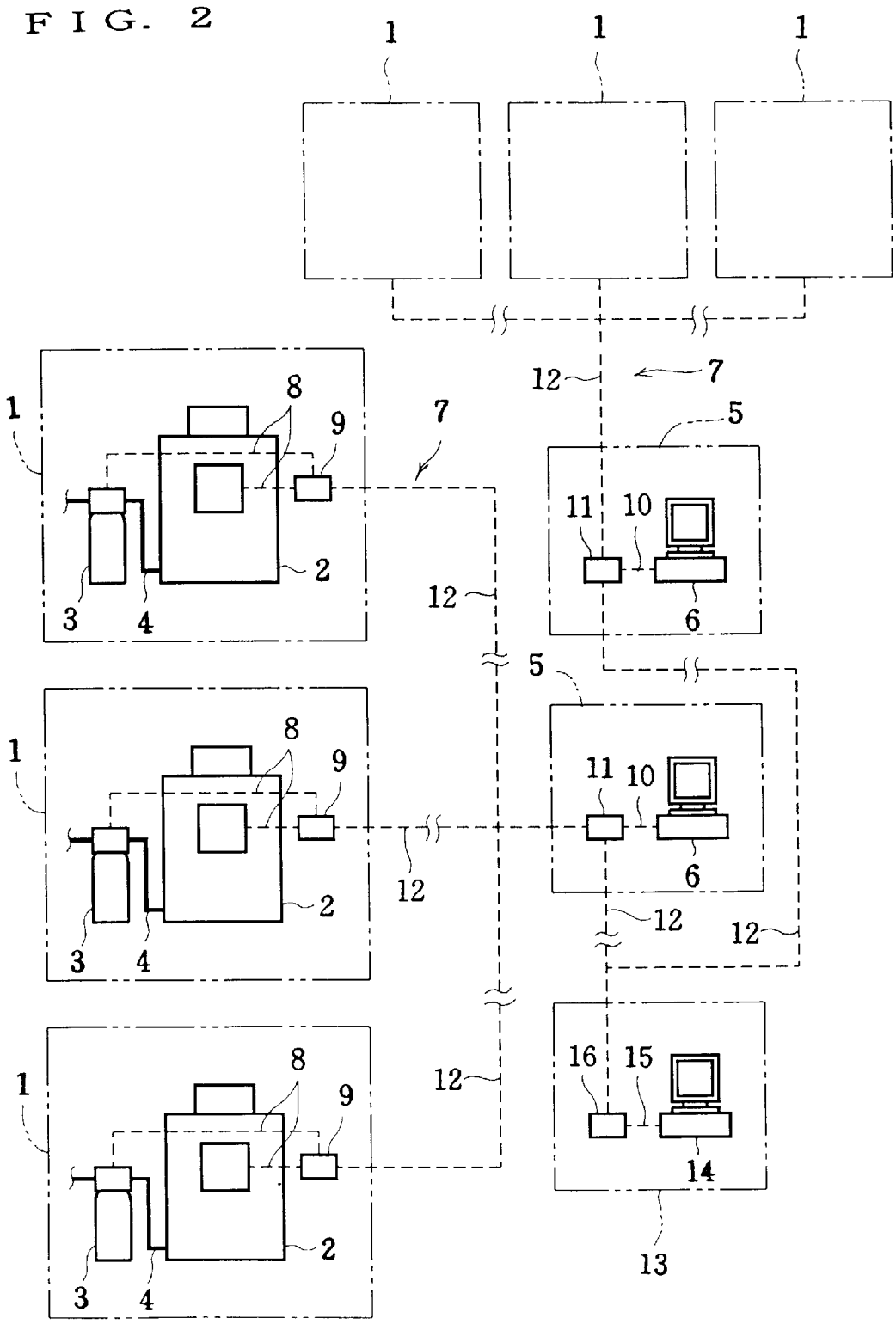
FIG. 2 is an explanatory view showing the general construction of the system in the invention.

Next, schematic construction of the system for implementing this invention is described with reference to FIG. 2. As shown in FIG. 2, heat supply equipment units 1, 1, . . . comprises boilers 2, 2, . . . , water softeners 3, 3, . . . , respectively, as maintenance object units. Then, these water sof teners 3 are connected to the boilers 2 via feed water lines 4, 4, . . . , respectively. Also, control stations 5, 5, . . . for executing the service and maintenance of the heat supply equipment units 1 are provided at the individual controlled areas, respectively, and first computers 6, 6, . . . are placed at these control stations 5, respectively. Then, the first computers 6 are connected to the boilers 2 and the water softeners 3 so as to be communicatable with each other via communication means 7, 7, . . . , respectively.

That is, computers (not shown) for the boilers 2 and the water softeners 3 are connected to first modems 9, 9, . . . via first signal lines 8, 8, . . . , respectively, and the first computers 6 are also connected to second modems 11, 11, . . . via second signal lines 10, 10, . . . , respectively, where the first modems 9 and the second modems 11 are connected to each other via a general telephone line 12. Accordingly, in this embodiment, each communication means 7 is composed of the first modem 9, the second modem 11 and the general telephone line 12, respectively, where operating information such as abnormality occurrence data, operating data and heat control data in the boilers 2 and the water softeners 3 are transmitted to the first computers 6 via the communication means 7.

A common control center 13 is provided for the control stations 5. Then, the operating information on the heat supply equipment units 1 is transferable from the first computers 6 to a second computer 14 set up in this control center 13. That is, the second computer 14 is connected to a third modem 16 via a third signal line 15, and this third modem 16 and the second modems 11 are connected to each other via the general telephone line 12.

Accordingly, the operating information on the heat supply equipment units 1 is transmitted to the computer 6, 14 and stored into the computers 6, 14. Further, the operating information is in some cases automatically fed from the heat supply equipment units 1, and in other cases fed according to a request signal from the computers 6, 14.

Next, concrete contents of the service and maintenance in this constitution are described with reference to FIGS. 3 to 6.

Figure 3:
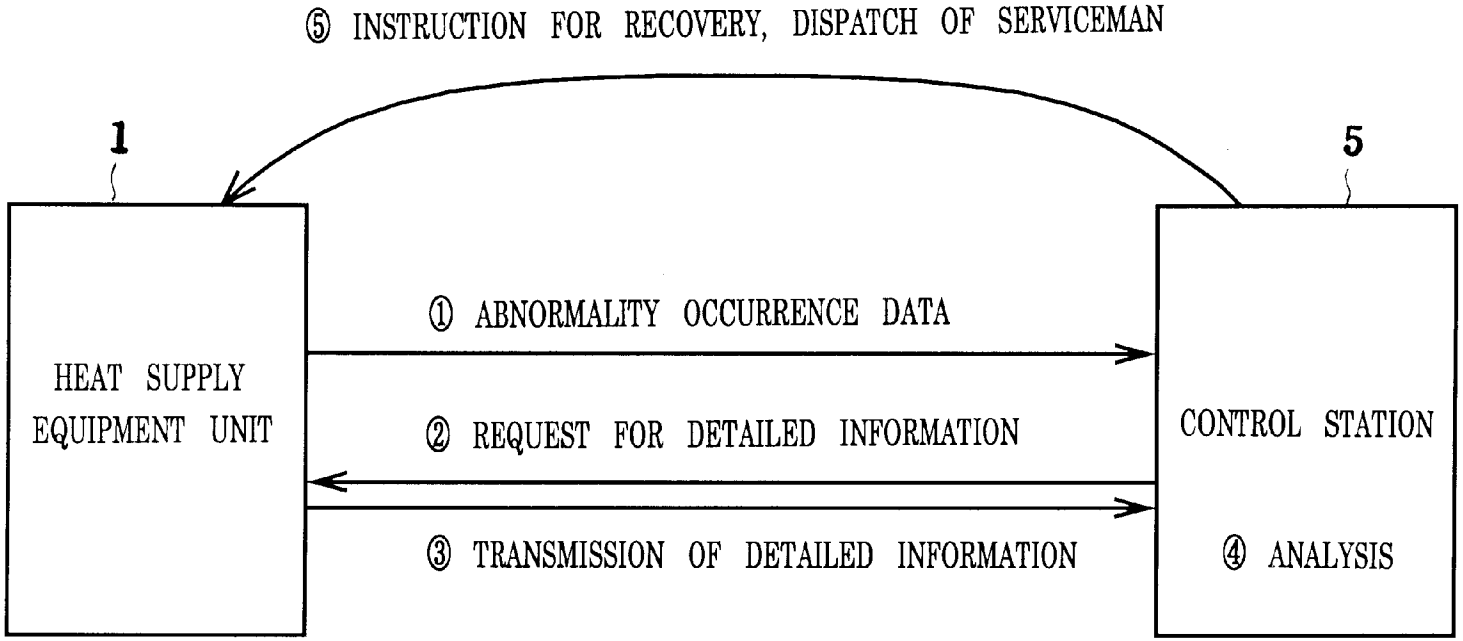
FIG. 3 is an explanatory view schematically showing the first process, the second process and the third process in the invention.

First, a first process, a second process and a third process in this invention are explained with reference to FIG. 3. As the first process, when an abnormality has occurred to the heat supply equipment units 1, data on occurrence of the abnormality is automatically transmitted to the first computers 6, and the transmitted abnormality occurrence data is received by the first computers 6. For example, when a non-ignition has occurred to any of the boilers 2, the abnormality occurrence data showing occurrence of a non-ignition is transmitted. Also, when the power of any feed water pump (not shown) has lowered, in which case a low water level is more likely to occur, the abnormality occurrence data as prediction data therefor is transmitted.

Upon reception of the abnormality occurrence data, as the second process, its contents are confirmed and then the first computers 6 are operated so that detailed information as to the abnormality occurrence data is requested of the heat supply equipment units 1 and then received. That is, a signal requesting the detailed information is transmitted from the first computers 6 to the heat supply equipment units 1, and in response to this request signal, the detailed information is transmitted from the heat supply equipment units 1 to the first computers 6.

Further, as the third process, the abnormality occurrence data and the detailed information are analyzed and, based on results of this analysis, an instruction for dispatch of a serviceman or recovery to the person in charge of management of the heat supply equipment units 1 is given. That is, the transmitted detailed information is displayed on a monitor screen of the first computer 6. Then, the control station 5 analyzes this information in combination with the contents of the abnormality occurrence data and, based on results of this analysis, takes measures. Accordingly, without going to the site where the heat supply equipment units 1 are installed, it can be correctly known what operating state each heat supply equipment unit 1 is currently in. Thus, a proper instruction for countermeasures can be taken immediately.

According to this third process, since it can be correctly known what operating state each heat supply equipment unit 1 is currently in, abnormalities can be recovered in more cases only by telephone instructions so that the time and labor of dispatch of a serviceman can be reduced to a large extent. Also, the halt time of the heat supply equipment units 1 can be shortened to a large extent. Further, even if a serviceman must go to the site, it is possible to specify the cause of the abnormality in advance and prepare parts and the like necessary for repair. Thus, the serviceman is allowed to begin the repair immediately at the site without the need for going to the site again.

Also, data to be transmitted as the abnormality occurrence data are not only abnormality data indicating that the heat supply equipment units 1 have halted due to occurrence of an abnormality, but also prediction data indicating that although the heat supply equipment units 1 do not have to be immediately halted, yet the heat supply equipment units 1 have a high probability of halt due to occurrence of an abnormality in a few days (e.g. data of degraded power of the feed water pump). Therefore, it is possible to take measures before the heat supply equipment units 1 halts. That is, on the ground that a forerunning phenomenon generally takes place before occurrence of an abnormality that would cause the heat supply equipment units 1 to halt, conditions for discriminating the forerunning phenomenon are set in advance, and the prediction data is transmitted according to these discriminative conditions. Accordingly, since the heat supply equipment units 1 have not yet halted at the time of transmission of the prediction data, it is enabled to take premeditated measures with a good time allowance such as countermeasures on the following day.

Figure 4:
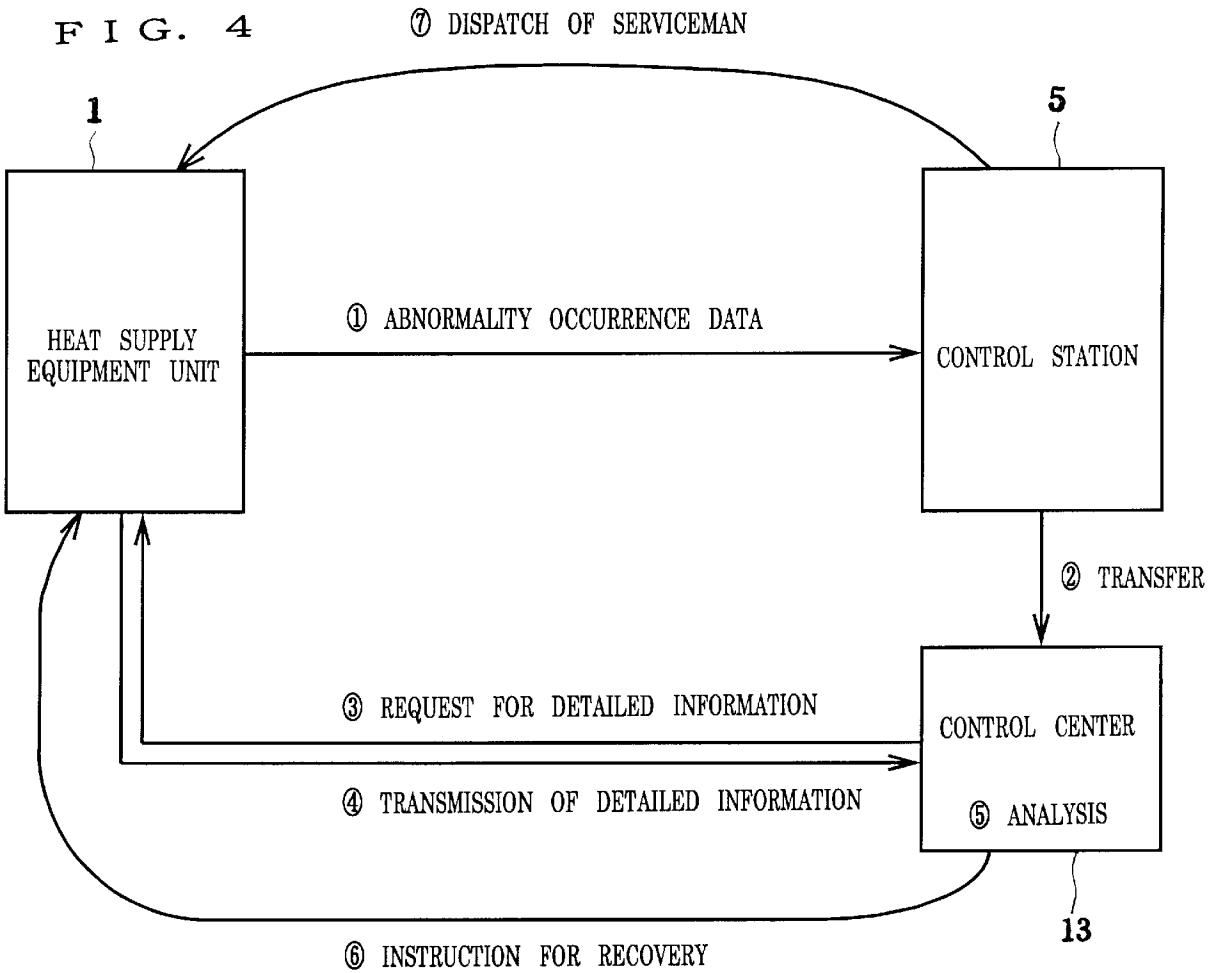
FIG. 4 is an explanatory view schematically showing the fourth process in the invention.

Next, the fourth process of this invention is described with reference to FIG. 4. In this fourth process, the control stations 5 make response to the reception of the abnormality occurrence data in the daytime on weekdays, and the control center 13 makes response to the reception of the abnormality occurrence data in the nighttime on weekdays and all days on holidays. Accordingly, servicing and maintenance of the heat supply equipment units 1 can be fulfilled continuously over 24 hours a day, and yet with the least staff efficiently. Also, in the control center 13, if recovery can be fulfilled by a telephone instruction, the control center 13 issues an instruction for recovery to the person in charge of management of the heat supply equipment units 1 by telephone. If dispatch of a serviceman to the site is necessary, the control center 13 makes an emergency contact with the serviceman in charge at each control station 5, and the serviceman in charge makes a response. In this case, the process of requesting and receiving detailed information associated with the abnormality occurrence data from the control center 13 to the heat supply equipment units 1 is the same as the second process and the third process, and thus omitted in description.

Figure 5:
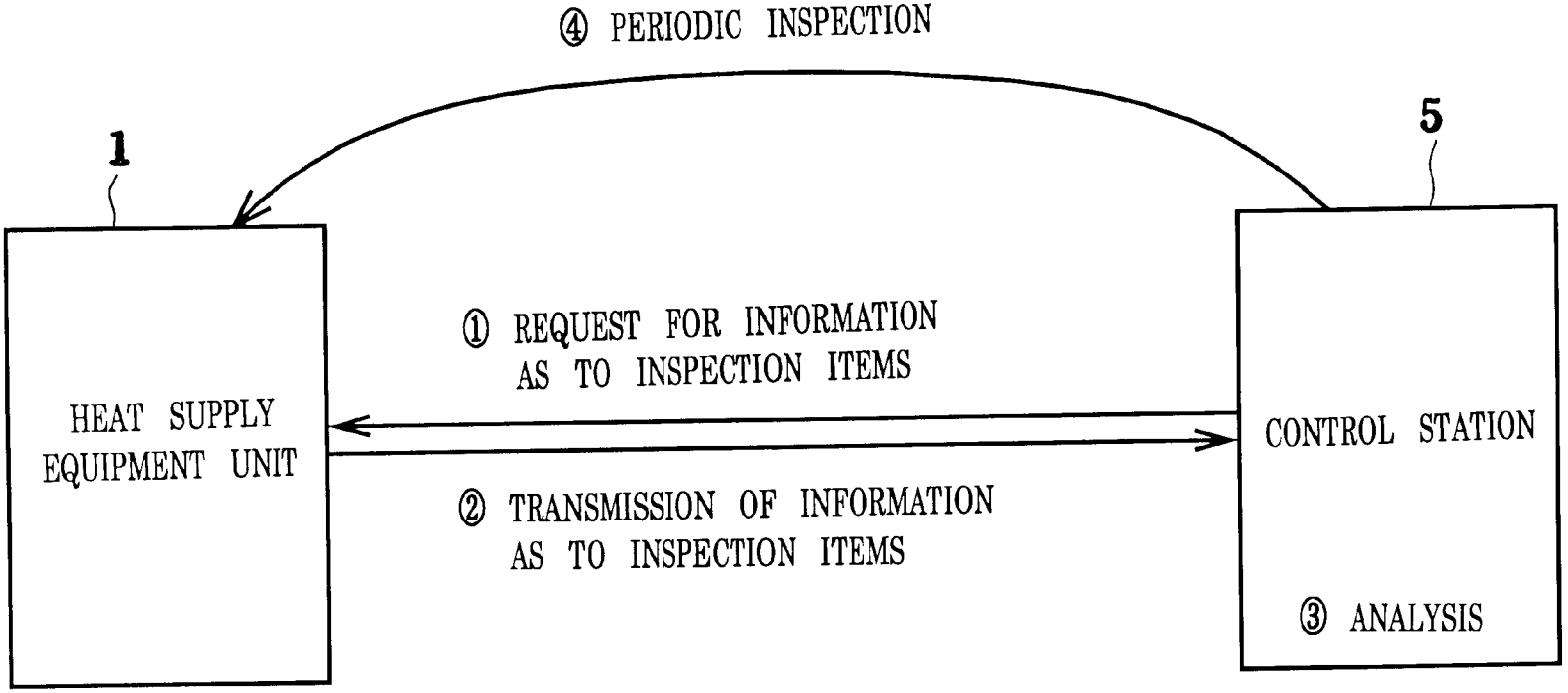
FIG. 5 is an explanatory view schematically showing the fifth process in the invention.

Next, the fifth process of this invention is described with reference to FIG. 5. In this fifth process, for the diagnosis, information as to the diagnosis of the heat supply equipment units 1, such as the abnormality occurrence data, operating data and heat control data, is obtained via the communication means 7, and then the obtained information is analyzed. In the example shown in the drawings, in periodic maintenances of the heat supply equipment units 1, information as to the inspection items is obtained in advance via the communication means 7 and then analyzed. In the case of the heat supply equipment units 1, on a basis of, for example, four months, a serviceman of the control station 5 goes to the heat supply equipment units 1 and perform periodic inspection, where before the periodic inspection, the serviceman obtains and analyzes the information in advance. As for the information to be obtained, for example, the number of ignitions or burning time or the like are obtained as the operating data, while data as to the operating efficiency, feed water pump power, water tube temperature and the like are obtained as the heat control data. More specifically, a signal for requesting these data is transmitted from the first computers 6 to the heat supply equipment units 1 and, in response to this request signal, the information is transmitted from the heat supply equipment units 1 to the first computers 6. Then, the transmitted information is outputted (printed out) as a report.

Accordingly, by analyzing the report before going to the periodic inspection, the serviceman is enabled to narrow the possible places that need an emphatic inspection and the possible places that need parts replacement with respect to equipment units targeted for the periodic inspection. As a result, the man-hours necessary for the periodic inspection at the site can be reduced to a large extent.

Further, based on the contents of the report, scale removal work or soot removal work is performed at the boilers 2 in order to maintain the operating efficiency at higher than a specified level. In this way, by taking measures for performance maintenance, the heat supply equipment units 1 can be operated at high efficiency at all times.

Figure 6:
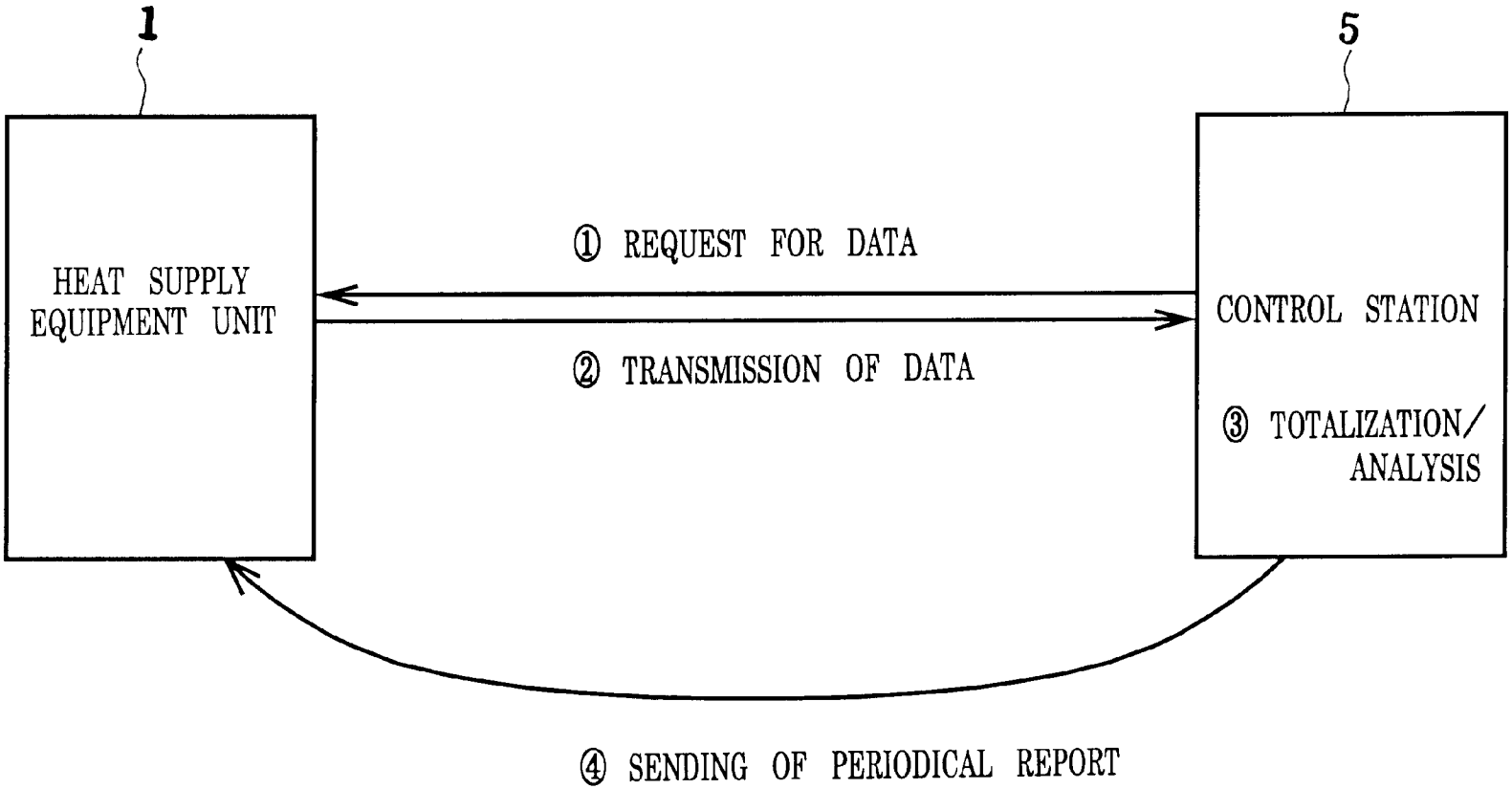
FIG. 6 is an explanatory view schematically showing another process in the invention.

Further, the process of sending a periodical report in this invention is explained with reference to FIG. 6. In this process, operating data and heat control data of the heat supply equipment units 1 are totaled periodically, for example every month, and analysis results or heat balance reports based on this totalization are offered to the servicing and maintenance contractor. That is, a signal requesting, for example, operating efficiency, amount of evaporation, use amount of fuel and the like as heat control data is transmitted from the first computers 6 to the heat supply equipment units 1 and, in response to this request signal, the data are transmitted from the heat supply equipment units 1 to the first computers 6. Then, the transmitted data are totaled, analysis results and heat balance reports based on this totalization are outputted (printed out) as a periodical report (monthly report), and this periodical report is sent to the servicing and maintenance contractor. Like this, by periodically sending the periodical report to the servicing and maintenance contractor, the servicing and maintenance contractor is enabled to know the operating status of the heat supply equipment units 1 and use the heat supply equipment units 1 with ease.

Without the occurrence of any abnormality in the heat supply equipment units 1, the abnormality occurrence data is never transmitted up. However, with occurrence of an abnormality in the communication means 7, it can occur that although the abnormality occurrence data is transmitted, yet the data does not reach the first computers 6. For such cases, the process of preparing the periodical report makes it possible to periodically ascertain whether or not the communication means 7 is in normal state. Thus, the reliability of the service and maintenance can be enhanced.

According to the present invention, preventive maintenance for heat supply equipment can be achieved securely and efficiently, making it possible to take countermeasures in advance before any abnormality occurs to the heat supply equipment so that the heat supply equipment to be operated without being halted. Besides, even if an abnormality should occur, a prompt countermeasure can be taken so that the resultant halt time can be reduced as much as possible. Moreover, the man-hours for implementing the service and maintenance can be reduced to a large extent, while a highly efficient service and maintenance can be fulfilled. Further, 24-hour response a day can be fulfilled with the least staff efficiently.

What is claimed is:

1. A method for servicing and maintaining heat supply equipment, which includes making a servicing and maintenance contract to implement equipment performance maintenance, function maintenance, abnormality recovery and a diagnosis for preventive maintenance of the heat supply equipment (1), providing a communication network of the heat supply equipment (1), a first computer (6) of a control station (5) and a second computer (14) of a control center (13) communicatable thereamong via communication means (7), and implementing contents of the servicing and maintenance contract based on information obtained by communications in this network, the method comprising the steps of:

upon occurrence of an abnormality, performing a sequence of processes that: when the first computer (6) receives abnormality occurrence data automatically transmitted from the heat supply equipment (1), the control station (5) confirms contents of the abnormality occurrence data and requests detailed information as to the abnormality occurrence data from the heat supply equipment (1), receives the information, the control station (5) analyzes the abnormality occurrence data and the detailed information and, based on results of this analysis, issues an instruction for dispatch of a serviceman or for recovery by a person in charge of management of the heat supply equipment (1);

in a case where the control station (5) makes no response such as in nighttime or on holidays, transferring the abnormality occurrence data from the first computer (6) to the second computer (14), and by the control center (13) instead of the control station (5), performing the sequence of processes, to thereby fulfill the contents of the servicing and maintenance contract over 24 hours a day; and for execution of the diagnosis, obtaining information relating to the diagnosis of the heat supply equipment (1) via the communication means (7) and performing an analysis of the obtained information.

2. The method for servicing and maintaining heat supply equipment according to claim 1, further comprising:

in a periodic inspection for fulfilling the contents of the servicing and maintenance contract, obtaining information as to inspection items in advance via the communication means (7) and analyzing the obtained information, so that possible places of object equipment units that need an emphatic inspection or possible places that need parts replacement can be narrowed down before the serviceman goes for the periodic inspection.

3. The method for servicing and maintaining heat supply equipment according to claim 1, further comprising:

periodically requesting and receiving operating data and heat control data from the heat supply equipment (1) so as to confirm whether or not the communication means (7) is in a normal state and, as required, transferring and storing the two types of data from the heat supply equipment (1) into the first computer (6).

4. The method for servicing and maintaining heat supply equipment according to claim 3, further comprising:

totaling the operating data and the heat control data and offering an analysis result or a heat balance report based on this totalization to the servicing and maintenance contractor.

* * * * *